United States Patent [19]

Hill

[11] 4,126,070

[45] Nov. 21, 1978

[54] KEYBOARD MUSICAL INSTRUMENT

[76] Inventor: Jeremy R. Hill, 87 Centre St., Dover, Mass. 02030

[21] Appl. No.: 763,996

[22] Filed: Jan. 31, 1977

[51] Int. Cl.[2] ..... G10H 1/00

[52] U.S. Cl. ..... 84/1.01; 84/1.17; 84/1.11; 84/1.19; 84/1.24; 84/DIG. 7; 84/DIG. 19

[58] Field of Search ..... 84/1.01, 1.17, 1.24, 84/1.11, 1.19, 423, 424–433, DIG. 7, DIG. 19, DIG. 8

[56] References Cited

U.S. PATENT DOCUMENTS

| | | | |
|---|---|---|---|
| 2,641,753 | 6/1953 | Oliwa | 84/1.01 X |
| 3,011,379 | 12/1961 | Corwin | 84/DIG. 19 X |
| 3,335,629 | 8/1967 | Brodin | 84/1.01 X |
| 3,514,522 | 5/1970 | Mussulman | 84/DIG. 19 X |
| 3,541,912 | 11/1970 | Radke | 84/1.17 |
| 3,555,166 | 1/1971 | Gasser | 84/1.01 |
| 3,610,799 | 10/1971 | Watson | 84/1.01 |
| 3,740,448 | 6/1973 | Olszowka et al. | 84/433 X |
| 3,835,235 | 9/1974 | Amano | 84/DIG. 7 X |
| 3,875,842 | 4/1975 | Kmetz | 84/1.01 |

*Primary Examiner*—Ulysses Weldon
*Attorney, Agent, or Firm*—Wolf, Greenfield & Sacks

[57] ABSTRACT

The hand-held instrument is preferably supported by a strap from the neck for one or two handed playing of a keyboard with switch and potentiometer controls of a remote synthesizer which may be basically of conventional design and include a plurality of output voice means. A lightweight keyboard assembly is mounted within an elongated premolded housing having a control panel comprised of control switches and light indicators. The instrument is preferably for playing by the right hand, and for the purpose of holding and controlling the stability of the instrument, the housing is formed with a left hand gripping hole or slot permitting the instrument to be firmly gripped. Adjacent the hole there are provided additional control knobs and push button switches which are easily operated by the left hand without any repositioning of the hand. An umbilical cord interconnects the hand supported keyboard musical instrument and the synthesizer apparatus. The control wires forming the umbilical cord are minimized by electronically scanning the keyboard by serially addressing each key to provide a serial pulse train representing the state of all keys. The control wiring is also minimized by tthe electronic scanning of each control switch in sequence to provide a further serial pulse train representing the state of all switches. The keyboard assembly fits within an opening in the housing and is of relatively simple and lightweight construction using optical interruptor means for sensing key depression rather than using mechanical contact sensing means.

27 Claims, 12 Drawing Figures

KEYBOARD MUSICAL INSTRUMENT

BACKGROUND OF THE INVENTION

The present invention relates in general to a keyboard musical instrument and is more particularly concerned with a hand supported keyboard device including controls and cord means coupling to a remote synthesizer for control thereof. The keyboard device is preferably provided with a strap for supporting the device from the player's neck or shoulders, and also includes a gripping hole or slot permitting the instrument to be gripped and stabilized.

Keyboard artists playing under live performance conditions have heretofore been confined by the size and weight of their instruments. In a mordern combo or rock group a performer may use a variety of keyboard instruments which include the piano, electric piano, organ and, more recently, the synthesizer. Whereas guitarists and other members of the group are free, by virture of the light weight and small size of their instrument, to move around, the total performance of the keyboard artist is limited by his restriction to one place. The present invention is characterized by a weight and size no more than those typical of an electrical guitar. Synthesizers incorporate a wide variety of controls necessary to voice the instrument for a particular sound. Other controls are used more primarily as sound modifies and their frequent use by a performer during a musical performance add interest and enhance the dynamic nature of the sounds produced. An important feature of the invention is to place this latter type of control within especially easy reach of the performer and to provide several variable controls and push buttons which are at all times immediately under the finger and thumb of the left hand which grips the instrument.

Due to the excessive number of connections which would normally be necessary to permit such extensive control of a remote synthesizer another feature of the present invention is the means whereby electronic sampling of keyboard and control switch conditions permits the umbilical connections between the invention and the controller to be minimized.

U.S. Pat. No. 3,335,629 shows a keyboard musical instrument supported by a strap from the player. The device shown in this patent is quite awkward and requires a relatively large cross section tube having a keyboard slideable within a cylindrical housing until it aligns with an aperture in the housing. This prior art device although a fairly complete device has somewhat limited use primarily for connection to an amplifier while the present invention is for connection to and control of a complicated organ or synthesizer. Further, this known device is not concerned with minimizing connections to the remote apparatus. In addition, there are a number of other drawbacks to the structure shown in this prior art patent, all of which will become more obvious upon a reading of the following objectives of this invention.

One object of the present invention is to provide an improved hand held keyboard musical instrument.

Another object of the present invention is to provide a hand held musical device for connection to a remote synthesizer or the like and including a keyboard and controller.

A further object of the present invention is to provide a hand supported musical device in which notes are played on a keyboard and which also provide means for easily holding and stabilizing the keyboard device. For this stabilization the housing of the device is usually provided with a gripping slot or hole normally held by the left hand. The device preferably also has control knobs and push buttons located on opposite surfaces adjacent the gripping hole which may be operated without repositioning the hand.

Still another object of the present invention is to provide a keyboard and controller device which may be easily operated either in a hand held position or in a stationary position. In a stationary position the device may be supported on a table or stand quite easily as the housing for the device has a substantially flat bottom surface. In the hand held position a strap is preferably provided for supporting the device from the neck or shoulder of the player. Alternative supports may include a waist belt.

Another object of the present invention is to provide a keyboard device that readily interfaces with a synthesizer and which uses a minimum number of individual control wires in the umbilical cord interconnecting the device and synthesizer.

Still a further object of the present invention is to provide a musical device as described hereinbefore and featuring a control panel comprised of switches, potentiometers and indicators with only a single control wire being necessary connecting to the remote synthesizer for sending periodically updated signals of the states of the different switches of the control panel.

Another object of the present invention is to provide a hand held keyboard device and a simplified means of sensing key depression employing an optical interruptor. A serial signal requiring only one control wire is also used for sending signals to the remote synthesizer indicating the states of the keys.

SUMMARY OF THE INVENTION

To accomplish the foregoing and other objects of this invention there is provided a keyboard musical device for controlling a remote voice-generating apparatus such as an electronic organ or synthesizer. The device of the present invention is preferably hand held although it may also be operated when on a supporting table in a stationary position. An umbilical cord interconnects the device to a remote synthesizer and the cord comprises a plurality of control wires for providing two-way communication between the synthesizer and the hand held musical device. The device of this invention comprises a keyboard assembly and an elongated two-piece housing preferably closed at opposite ends and being provided with an opening for accommodating the keyboard assembly. This housing preferably has a substantially flat bottom walled surface and a top wall surface. The flat bottom wall surface may have a plurality of relatively short legs for permitting the device to rest on a support table or stand when not hand held. Printed circuit boards are mounted within the housing and one of these boards contains key scanning electronics and optical interruptor sensors while another board may contain switch encoder circuits.

The housing is provided with an passage therein having opposite ends that terminate at opposite surfaces of the housing including the flat bottom wall surface. This passageway is disposed adjacent one end of the keyboard and there are preferably provided a plurality of control knobs disposed adjacent the passage for control by the fingers of the player. In the disclosed embodiment there are four control knobs on the top surface adjacent the passage for manipulation by the player's fingers and two control knobs on the bottom surface adjacent the passageway for control by the player's thumb.

The keyboard assembly is of lightweight construction including a series of plastic keys preferably interconnected by a common shaft. Each key has associated therewith return spring means, an adjustable stop and a light baffle. The depressing of a key is sensed individually by an optical interruptor means which may comprise a light emitting diode and phototransistor with the light baffle arranged to interrupt the light beam therebetween. In accordance with the invention and because it is desirable to reduce the number of control wires coupled from the keyboard device an electronic scanning technique is used for scanning each key by means of serially addressing each key along the keyboard. This results in a serial pulse train carried on a single wire and representative of the state of all keys.

The top wall of the housing above the keyboard is preferably provided with a tilted surface for accommodating a control panel in a convenient viewing position. This control panel has a series of indicators, preferably 10 toggle switches, and preferably 10 momentary push button switches. The indicators, for example, may identify the selected filter mode. A number of the indicators identify the condition of the toggle and momentary switches associated therewith. A further feature, which eliminates the need for a multiplicity of wires from the control panel, is an electronic scanning technique in accordance with the invention wherein each switch is scanned by the sequentially progressing address code. In this way, a single control wire carries a serial pulse train which represents the state of all switches.

BRIEF DESCRIPTION OF THE DRAWINGS

Numerous other objects, advantages and features of this invention should now become apparent upon a reading of the following detailed description taken in conjunction with the accompanying drawings, in which.

DETAILED DESCRIPTION

Figure 1:
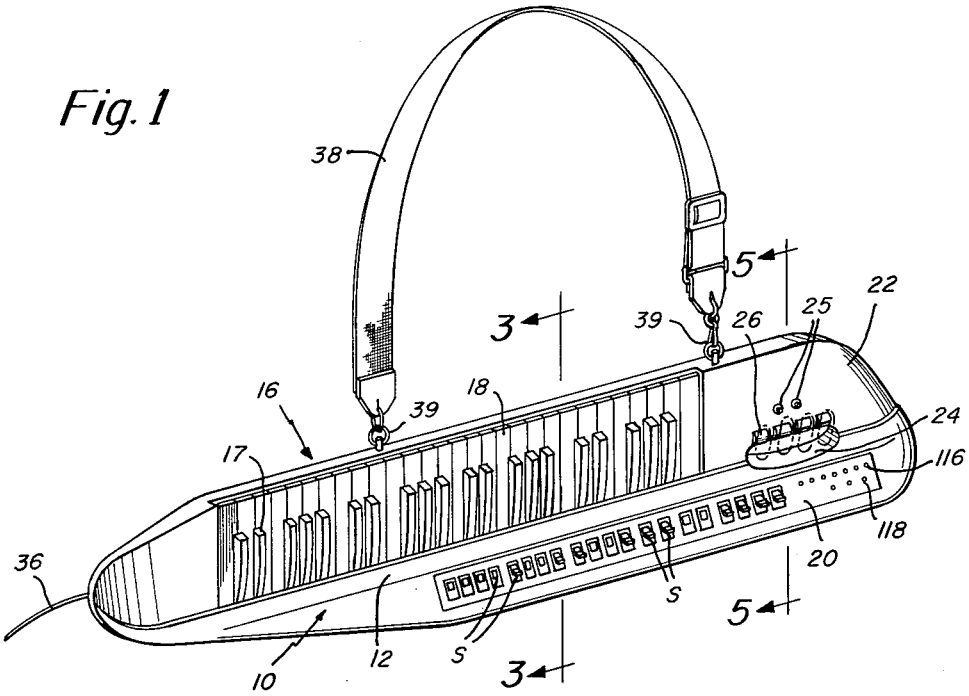
FIG. 1 is a perspective view of the keyboard device of the present invention showing the supporting strap and umbilical cord.
Figure 2:
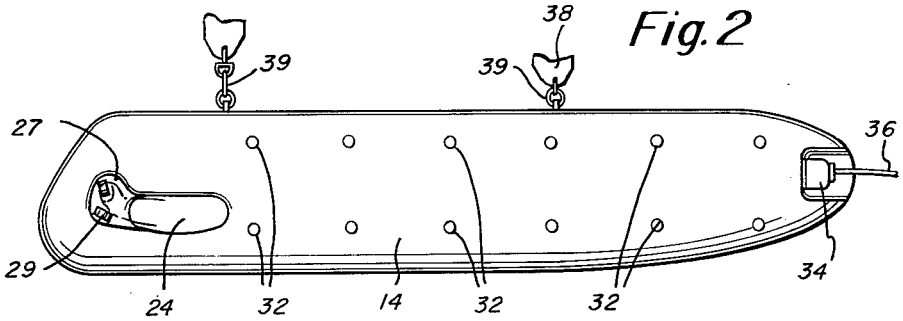
FIG. 2 is a rear elevation of the device shown in FIG. 1.
Figure 3:
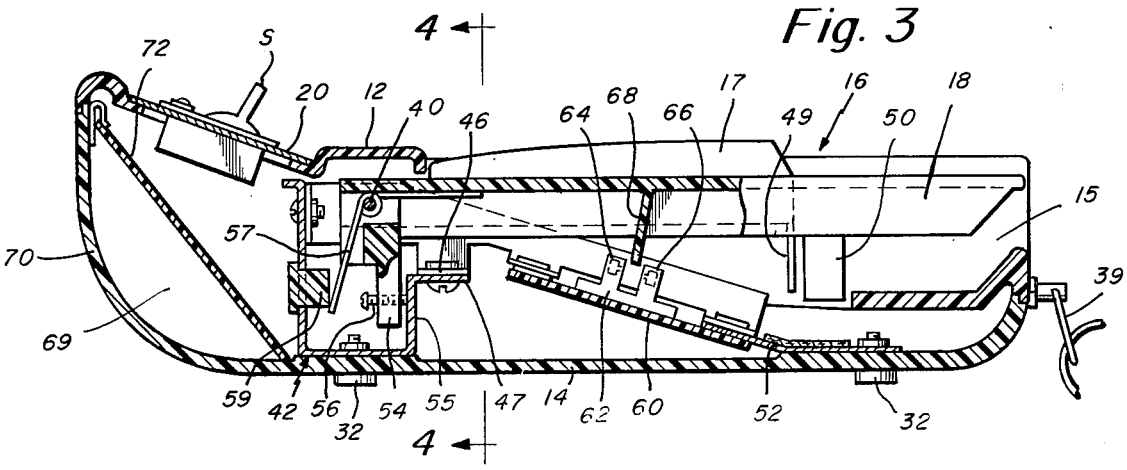
FIG. 3 is a cross-sectional view through the keyboard and taken along line 3—3 of FIG. 1.
Figure 4:
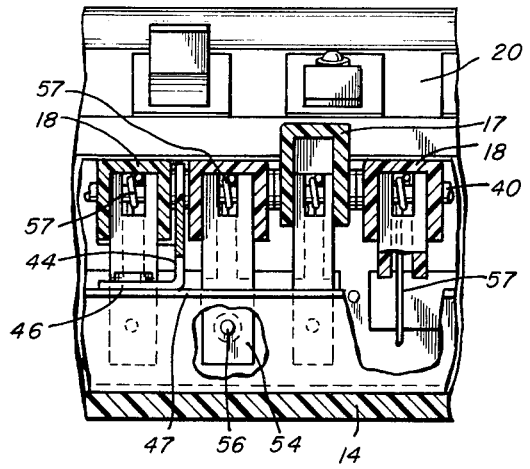
FIG. 4 is a cross-sectional view taken along line 4—4 of FIG. 3.
Figure 5:
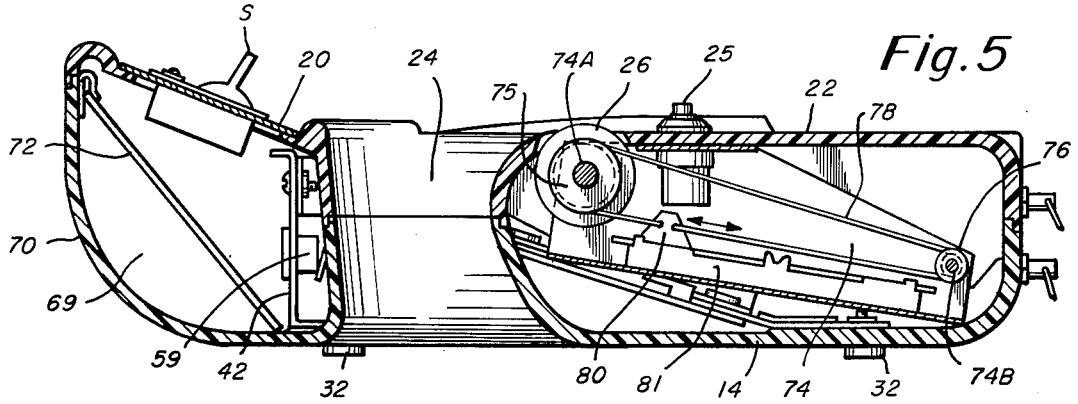
FIG. 5 is a cross-sectional view taken along line 5—5 of FIG. 1.

Referring now to the drawings and in particular FIGS. 1 and 2, there is shown the musical device of the present invention in a preferred embodiment. FIGS. 3–5 are cross-sectional views showing further details of the device. The device comprises an elongated housing 10 which is preferably constructed in two-pieces including a top wall 12 and a relatively flat bottom wall 14. The top wall 12 of the housing has an elongated opening 15 as shown in FIG. 3 for accommodating the keyboard assembly 16 which includes the typical black keys 17 and white keys 18. The top wall 12 of the housing is also provided with another elongated aperture for receiving a control panel plate 20 shown in FIGS. 3 and 5. A plurality of switches and indicator lights are mounted upon the panel 20 and are discussed in more detail hereinafter with reference to the electronics of the device. It is noted that the control panel plate 20 is tilted relative to the keyboard assembly so as to provide easy reading of the positions of the switches.

At the end 22 of the housing 10 there is provided a through passage 24 extending between the top and bottom wall surfaces of the housing. FIG. 1 shows the player's fingers in phantom extending through the passage 24 for contact with rotatable control knobs 26 also discussed in more detail hereinafter. These control knobs 26, such as the one shown in FIG. 5 are easily manipulatable by the player's fingers as the instrument is grasped by the left hand. Of course, the instrument of this invention may also be constructed for grasping by the right hand with the left hand being used for playing the keyboard, in which case the passage 24 is at the opposite end of the housing. On the bottom wall 14 there is provided a recessed area 27 having two knobs 29 mounted therein. FIG. 2 shows the thumb in phantom extending over one of the knobs 29 for selective control thereof.

The device of this invention is also useable in a stationary position and for that purpose the bottom wall 14 is provided with a plurality of relatively short, preferably rubber legs 32 for supporting the housing above a rest surface such as a table or stand. FIG. 2 also shows the electrical connector 34 to which one end of the umbilical cord 36 connects. The cord 36 contains a plurality of control wires discussed in detail hereinafter with reference to the electronics of the invention.

In addition to the stationary position of use of the device of this invention, it is preferably used by supporting the device from the player's neck or shoulders by means of a strap 38 shown in FIG. 1 connecting by adjustable clips 39 to spaced positions along the housing. It is noted in FIG. 1 that the strap preferably is separated by clips 39, a distance less than the total length of the keyboard. The distance between the clips 39 is preferably on the order of the width of the player's body. With this type of support, players can play one-handed or can even support the device totally from the neck or shoulder and play two-handed without any interference from the strap 38.

The key assembly 16 shown in FIGS. 3 and 4 is supported within the aperture 15 in the housing the comprises the conventional sequence of black and white keys, a common connecting shaft 40 and a key support bracket 42. Each of the keys, as depicted in FIG. 4, has preferably a U-shaped cross section with oppositely disposed passages for receiving the common connecting shaft 40. The shaft 40 is suitably supported along its length by periodically disposed support brackets 44, each of which has a bottom leg 46 fixedly supported from the key support bracket 42 along its extending flange 47. The shaft supporting brackets 44 may be disposed at equal or somewhat random intervals along the keyboard preferably spaced about every six or seven keys.

The black and white keys are provided at or near their forward end with downwardly depending key stops 49 and 50. These stops limit the downward depression of the keys as both of the stops are meant to contact a felt-backed stop plate 52 as shown in FIG. 3. As previously mentioned, the keys are all pivotally interconnected by the shaft 40 and each key has a downwardly extending leg 54 extending adjacent to the wall 55 of the support bracket 42. A set screw 56 extends through the wall of the leg 54 and contacts the wall 55. The stop adjustment screw 56 sets the horizontal key position when the keys are not depressed. A relatively simple return spring 57 is supported about the shaft 40 at each key and biases the keys to their non-depressed position with the screw 56 adjustable to set this horizontal position. The spring 57 has its free end contacting the spring stop plate 59 which is removably secured to the support bracket 42. This elongated stop plate 59 may be entirely removed to provide access to the set screws 56 for adjusting the position of the keys. When the plate 59 is removed this also frees the biasing force on the springs 57.

The brackets 44 for supporting the shaft 40 also form a support bracket for the printed circuit board 60. The board 60 may support, inter alia, the optical interruptor means of this invention. FIG. 3 shows a holding member 62 for supporting a photo-transistor 64 spaced from a light emitting diode 66. There are of course, a combination of photo-transistors and light emitting diode associated with each key and in this connection each key is provided with a downwardly depending light baffle 68 which is adapted to interrupt the light path between the light emitting diode and the photo-transistor when the keys are depressed. It can be easily seen in FIG. 3 that when the key is depressed the light baffle 68 passes between the photo-transistor 64 and the light emitting diode 66. A further discussion of the operation of the optical interruptor is taken up hereinafter with reference to the electronics in FIG. 6.

The printed circuit board 60 in addition to supporting the optical interruptor and other circuitry also provides mechanical rigidity for the entire keyboard assembly. The light baffle is preferably constructed of a 1/16th inch thick black plastic strip bonded to each key. In an alternate embodiment of the invention one might use in place of the light emitting diodes a light channel using several light sources channeled by means of light ways molded into the housing and internally treated with high reflectivity paint.

As noted in FIG. 3 there is also provided an open space 69 between the housing end 70 and the support bracket 42. This space 69 may have mounted therein another printed circuit board 72 for mounting other portions of the electronics shown in FIG. 6.

FIG. 5 is another cross-sectional view taken through the instrument shown in FIG. 1 in the area of the passage 24. FIG. 5 clearly shows one of the rotatable control knobs 26 which is easily accessible by the fingers of the hand extending through the aperture 24 in the housing. As depicted in FIG. 1 there are actually four of these control knobs 26 and associated potentiometers which are discussed in detail hereinafter with reference to the electronics and in particular to FIG. 12.

The knobs 26 have associated therewith a U-shaped mounting bracket 74 suitably supported within the housing and having shafts 74A and 74B extending between sides thereof for carrying a first pulley 75 supporting the knob 26 and a second pulley 76 spacedly mounted from the first pulley. A nylon cord 78 extends between the pulleys 75 and 76 and connects at its ends to post 80 of the slide potentiometer 81. By rotating the knob 26 the sliding post 80 of the slide potentiometer 81 can be moved from one end to the other. In FIG. 5 the post is shown in solid at one end of the potentiometer and in dotted at the other end of the potentiometer. Again, hereinafter there is a description of the operation of these components.

FIG. 5 also shows a momentary push button switch 25. As shown in FIG. 1 there are actually two of these momentary push button switches, each of which operates a counter means as discussed in more detail hereinafter. The push buttons 25 are also within easy access to the fingers of the player.

Figure 6:
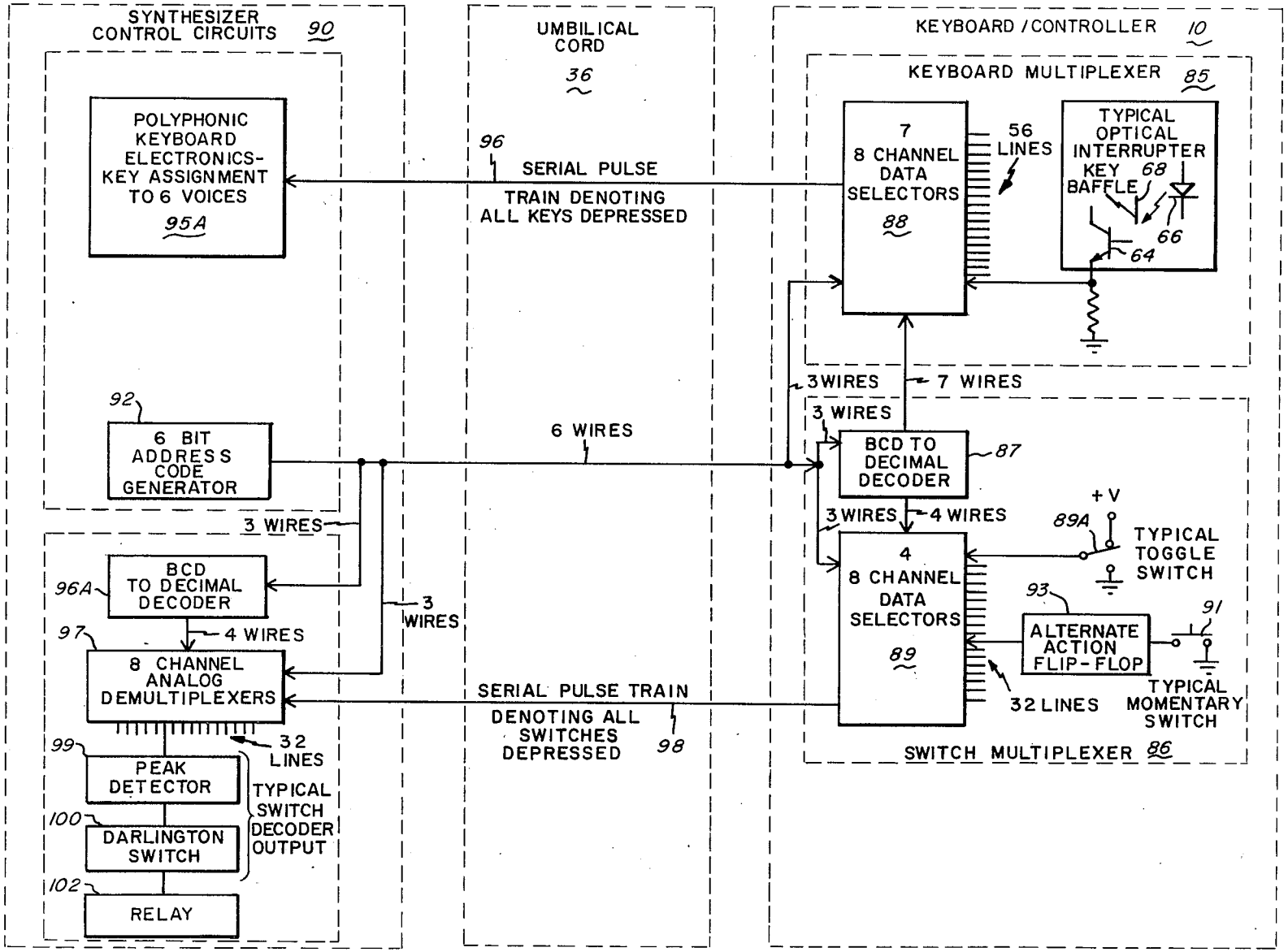
FIG. 6 is a block diagram of the electronics associated with the device of this invention.

FIG. 6 shows a block diagram of the electronics of the present invention including the keyboard multiplexer 85, the switch multiplexer 86, some of the control wiring in the umbilical cord 36, and synthesizer control circuitry 90. The additional detail of the blocks shown in FIG. 6, is shown in the remaining FIGS. 7–12. Part of the synthesizer 90 comprises a 6 bit address code generator 92 which may be an essentially free-running generator sending address control signals in binary form to the keyboard and controller device 10. In FIG. 6 the six wires are shown as a single wire for the sake of simplicity. These binary signals couple in two pairs of three code wires each to the BCD to decimal decoder 87, the data selector 88, and the data selector 89. Both of the data selectors are essentially scanning devices with the data selector 88 essentially scanning the state of the keys and the data selector 89 essentially scanning the state of the switches on the control panel of the device. FIG. 6 shows schematically one of the fifty-six optical interruptors which comprise the light emitting diode 66 and the photo transistor 64. Similarly, FIG. 6 shows a typical arrangement for the switches including a toggle switch 89A and a typical momentary switch 91 connected by way of flip-flop 93 to one of the 32 lines connecting to the other data selector 89. The outputs of both of the data selectors are serial pulse trains and thus in FIG. 6 there are shown two return wires coupling to the synthesizer 90 and six control wires coupling from the synthesizer to the device 10. In addition, there are four wires required for power supply transmission. One additional wire is also associated with each of the six control potentiometers 26 and 29, accounting for a total of 18 wires in the cord 36, only some of which are shown in FIG. 6.

Figure 11:
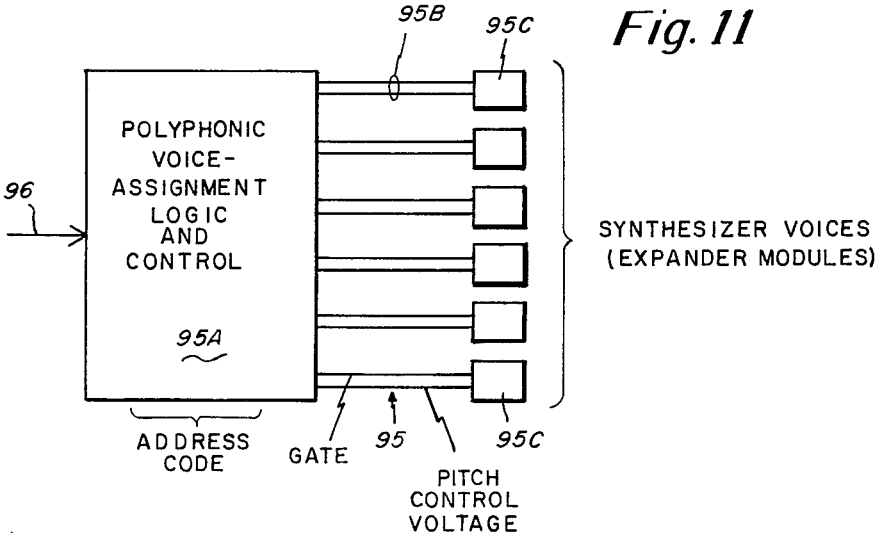
FIG. 11 is a block diagram showing some further detail of the remote synthesizer shown in block form in FIG. 6.

FIG. 6 also shows a polyphonic keyboard electronics 95A to which the control wires 96 connects. Further detail of the electronics 95 is shown in FIG. 11.

The six bit code from generator 92 also couples to a BCD to decimal decoder 96A and an analog demultiplexer 97. The device 97 is essentially providing a scanning of the signal on line 98 from the data selector 89. FIG. 6 shows a typical output from one of the output lines of demultiplexer 97 which couples to a peak detector 99, a Darlington switch 100 and a relay 102. The operation concerning these devices is discussed in more detail hereinafter.

Figure 7:
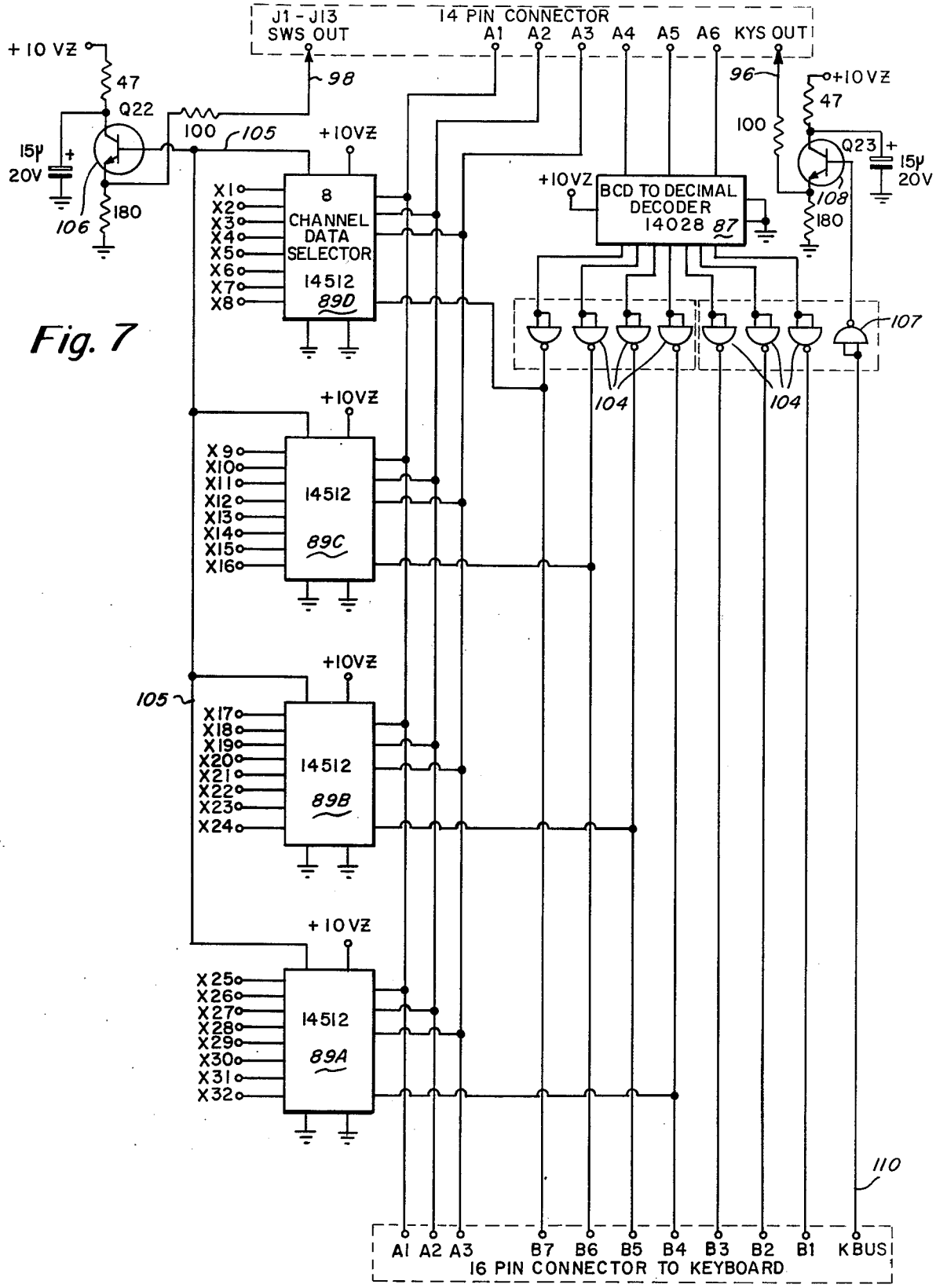
FIG. 7 is a detailed diagram of a portion of the system shown in the block diagram of FIG. 6 and specifically identified as the switch multiplexer.

FIG. 7 shows some further detail of the decoder 87 and the selector 89. In FIG. 7 there are six inputs A1-A6 which represent the six address control wires coupled from the synthesizer. The line A6 represents the most significant bit while the line A1 represents the least significant bit of the overall code. The three most significant bits A4-A6 couple to the decoder 87 which is a standard circuit such as one made by Motorola and identified as their number 14028. The device 87 provides seven output lines, any one of which may be active depending upon the input code to the decoder 87. The output signals are coupled by way of gates 104 which are NAND gates to provide the seven output signals B1-B7 which couple to the data selector 88 discussed in more detail hereinafter with reference to FIG. 8. Four of the decoded signals B4-B7 couple respectively to selector circuits 89A, 89B, 89C and 89D. Each of these selector circuits may be of the type sold by Motorola and identified as their 8 channel data selector number 14542. Each of these signals B4-B7 in sequence enables one of the data selector circuits. Each of the data selectors also includes the control signal inputs A1-A3. Thus, for example, when the data selector 89A is enabled by the signal on line B4 then in sequence the lines X25-X32 are scanned in accordance with the input from lines A1-A3 to provide an output signal on common line 105 which is coupled by way of transistor 106 to the serial pulse train output line 98 also referred to in FIG. 6. In FIG. 7 each of the input terminals X1-X32 connect from different switches as discussed in detail hereinafter with reference to the diagrams of FIGS. 9 and 10.

FIG. 7 also shows the K-BUS line which couples by way of gate 107 and emitter follower transistor 108. The output from this transistor couples to the serial pulse train line 96 also shown previously in FIG. 6. The K-BUS signal is coupled from the circuitry shown in FIG. 8.

Figure 8:
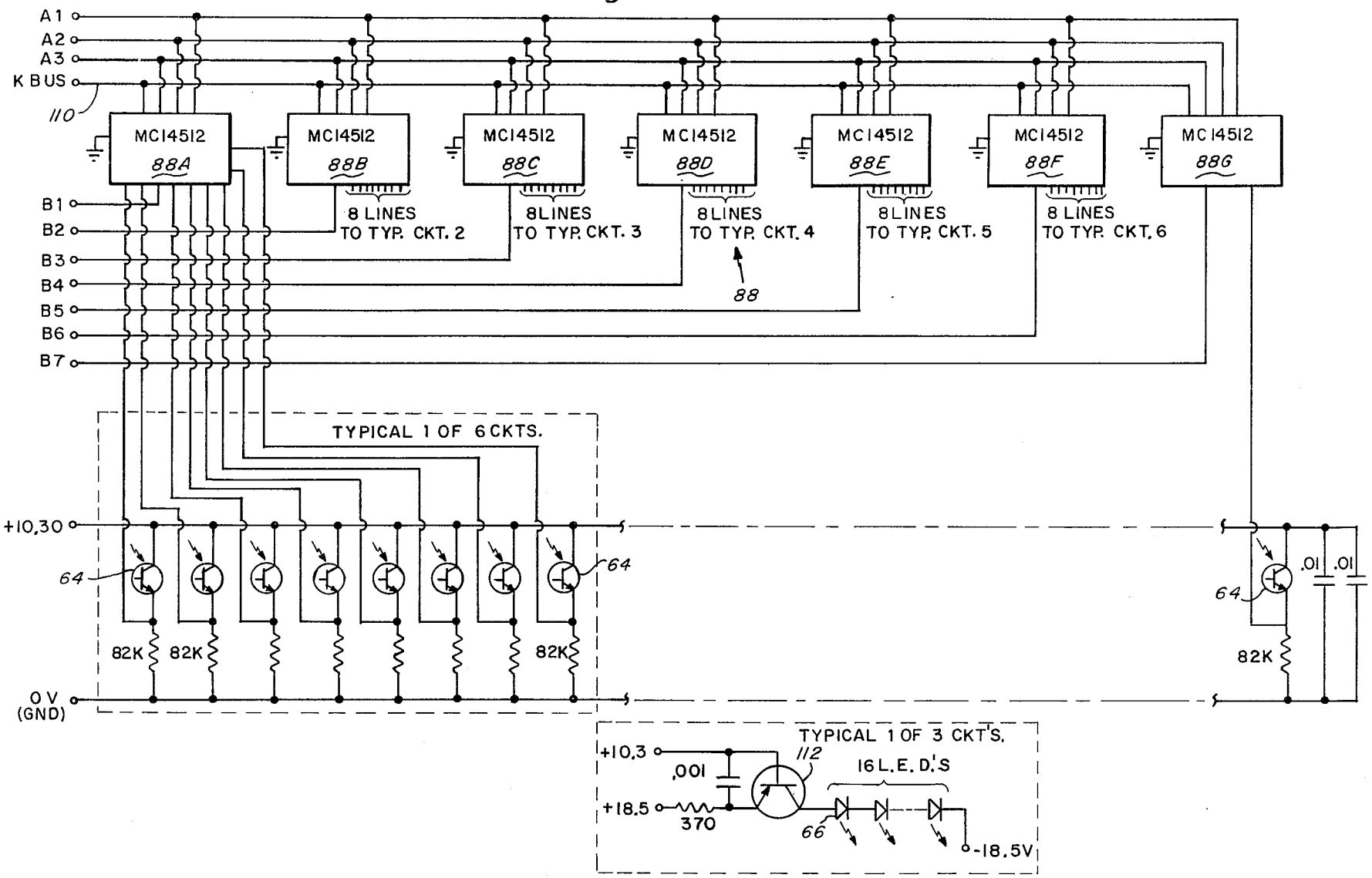
FIG. 8 is a more detailed diagram of another portion of the electronics shown in the block diagram of FIG. 6 including the keyboard multiplexer and optical interruptor sensors.

FIG. 8 basically shows the keyboard multiplexer 85 which comprises selector 88 and the optical interruptor means. The data selector 88 as indicated in FIG. 6 has 56 input lines, only forty-nine of which are used corresponding to the number of keys on the keyboard. In FIG. 8 the data selector 88 comprises seven 8-channel data selector circuits 88A, 88B, 88C, 88D, 88E, 88F and 88G. Each of these data selector circuits 88A-88G may be of the type sold by Motorola and identified as their data selector circuits MC14512. The inputs to each of the data selectors includes the input control address lines A1-A3 and also one of the lines B1-B7. Because only one of the lines B1-B7 is enabled at any one time, these signals essentially select in sequence, each of the data selector circuits. The code on lines A1-A3 then select which one of the eight input lines from the photo-transistors 64 will be interrogated. The outputs from each of the data selector devices tie in common on line 110 which has been previously identified as the K-BUS line also shown in FIG. 7 coupling to the output line 96. There is thus provided on the output line 96 by way of line 110 a serial pulse train with time slots in the pulse train being provided on an addressed basis and being representative of the state of the keys. This scanning technique is of course repeated so that there is a constant updating of key actuations.

In FIG. 3 the photo-transistor and light emitting diode are shown regarding their positional relationship. In FIG. 8 there is shown the series of photo-transistors each having resistors associated therewith. The emitter of each photo-transistor 64 couples to one of the selectable inputs of the data selector 88. FIG. 8 also shows the light emitting diodes 66 which are equal in number to the number of photo-transistors and the number of keys on the keyboard. A current source is used to drive these light emitting diodes and comprises a transistor 112 which functions as a current source for groups of these diodes. The light baffle associated with each key interrupts the light path between its corresponding diode and photo-transistor and this is sensed by the photo-transistor which will reduce in conduction. This change of state of the photo-transistor is sensed by the data selector circuitry. Thus, in considering any one particular key when the address code sequences to the position for interrogating that particular key and if the photo-transistor has a reduced conduction then a negative pulse in that particular time slot is conveyed from the data selector circuitry, indicative of the depressing of the particular key. In FIG. 8 one set of 16 light emitting diodes is shown, it being understood that there are actually three sets containing respectively 16, 16 and 17 diodes to cover the 49 keys of the keyboard.

Figure 9:
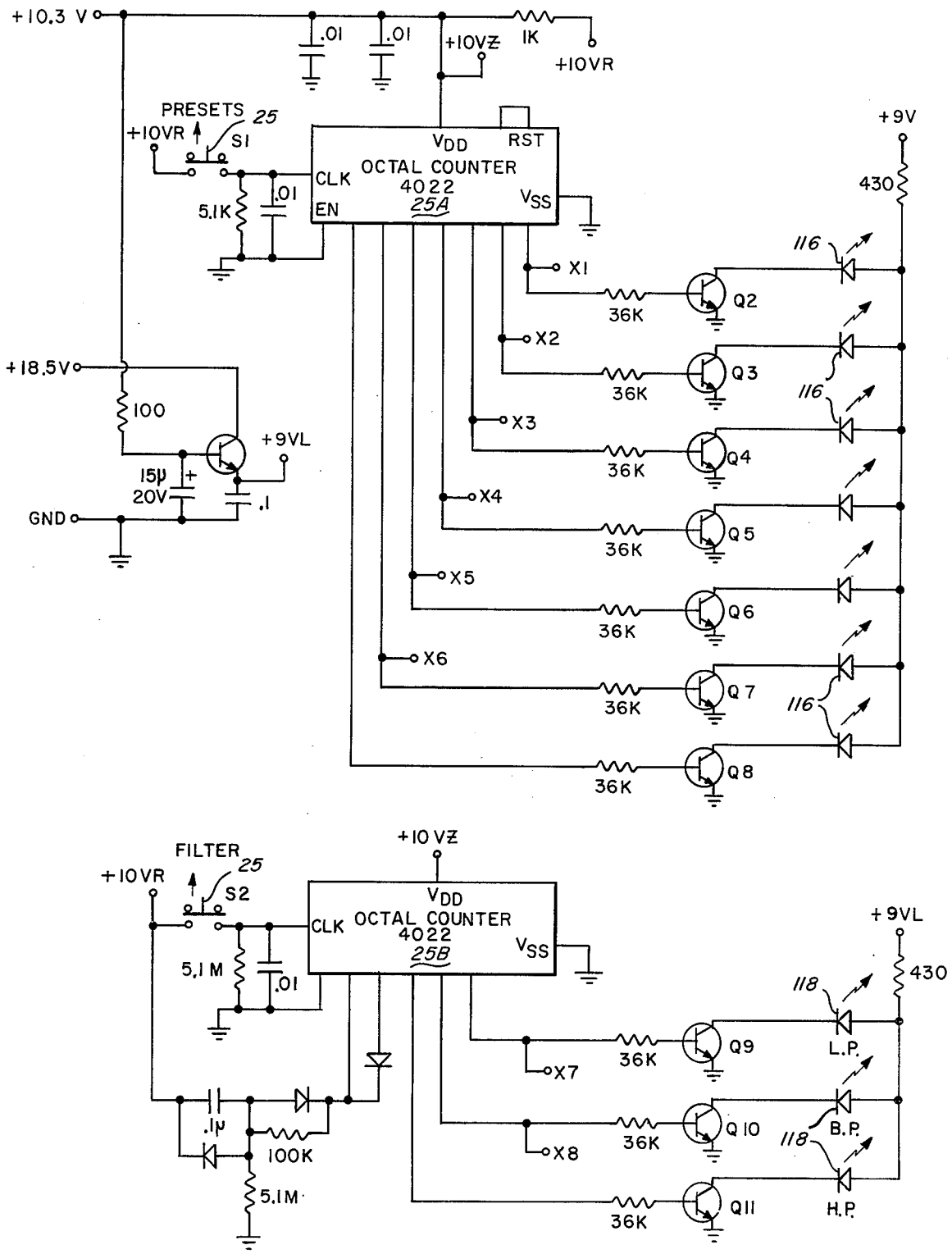
FIG. 9 shows the details of the keyboard switch encoder circuits including the push button switch operated counters.

FIG. 9 shows the push button switches 25 and their associated circuitry including octal counters 25A and 25B. The two push button switches 25 are disposed as indicated in FIG. 1 so that they are available to the index and third fingers as these fingers protrude beyond the side mounted potentiometer knobs 26. The push button 25 that couples to the counter 25A is used to sequence through seven "presets". Thus, the counter 25A is shown as having seven discreet outputs, six of which namely X1-X6, are interrogated by being connected to the data selector 89D. The outputs from the counter 25A couple respectively by way of a resistor and transistor to a plurality of separate light emitting diodes 116. FIG. 1 shows the light emitting diodes 116 mounted on the control panel 20. The counter 25 is incremented each time that the switch 25 associated therewith is depressed. Thus, the player of the instrument can in sequence increment the counter to provide any one of seven different outputs and the output that has been selected has been indicated by the illumination of its corresponding light emitting diode. In the remote synthesizer there is provided a programmer by means of which seven synthesizer voices can be programmed into a memory. The particular position selected for the counter 25A determines which of these pre-programmed voices is selected.

The second push-button 25 similarly has three outputs that couple by way of a resistor and transistor combination to light emitting diodes 118. Two of these outputs X7 and X8 couple to the data selector 89D. With regard to both counters 25A and 25B one less than all of the outputs are transmitted as this is all the information that is necessary for the synthesizer. For example, if the sequential signal from the data selectors indicates that the counter is in neither position X7 or X8, then it must be in the only other remaining position of the counter. The pushbutton associated with counter 25B is used to control the mode of the dynamically controlled filters associated with each synthesizer voice. Momentary depression of this push button allows sequential selection of low pass, band pass or high pass filter modes.

The circuitry coupling each of the switches 25 to their corresponding counters and FIG. 9 is for the purpose of preventing sequential counting upon a single depression.

TABLE I

CONTROL SWITCH ADDRESSES

| Name | Connection to Data Selector | Code A6 | A5 | A4 | A3 | A6 | A1 |
|---|---|---|---|---|---|---|---|
| Preset Voice 1 | X1 | 0 | 0 | 0 | 0 | 0 | 0 |
| Preset Voice 2 | X2 | 0 | 0 | 0 | 0 | 0 | 1 |
| Preset Voice 3 | X3 | 0 | 0 | 0 | 0 | 1 | 0 |
| Preset Voice 4 | X4 | 0 | 0 | 0 | 0 | 1 | 1 |
| Preset Voice 5 | X5 | 0 | 0 | 0 | 1 | 0 | 0 |
| Preset Voice 6 | X6 | 0 | 0 | 0 | 1 | 0 | 1 |
| Low Pass Dynamic Filter | X7 | 0 | 0 | 0 | 1 | 1 | 0 |
| Band Pass Dynamic Filter | X8 | 0 | 0 | 0 | 1 | 1 | 1 |
| Glide | X9 | 0 | 0 | 1 | 0 | 0 | 0 |
| R Mode | X10 | 0 | 0 | 1 | 0 | 0 | 1 |
| RC Mode | X11 | 0 | 0 | 1 | 0 | 1 | 0 |
| Unison | X12 | 0 | 0 | 1 | 0 | 1 | 1 |
| Split | X13 | 0 | 0 | 1 | 1 | 0 | 0 |
| Clock | X14 | 0 | 0 | 1 | 1 | 0 | 1 |
| Record | X15 | 0 | 0 | 1 | 1 | 1 | 0 |
| Echo | X16 | 0 | 0 | 1 | 1 | 1 | 1 |
| Flanger | X17 | 0 | 1 | 0 | 0 | 0 | 0 |
| Sync | X18 | 0 | 1 | 0 | 0 | 0 | 1 |
| First Pitch Saw | X19 | 0 | 1 | 0 | 0 | 1 | 0 |
| First Pitch Pulse | X20 | 0 | 1 | 0 | 0 | 1 | 1 |
| First Pitch Transpose Up | X21 | 0 | 1 | 0 | 1 | 0 | 0 |
| First Pitch Transpose Down | X22 | 0 | 1 | 0 | 1 | 0 | 1 |
| 2nd Pitch on/off | X23 | 0 | 1 | 0 | 1 | 1 | 0 |
| 2nd Pitch Saw | X24 | 0 | 1 | 0 | 1 | 1 | 1 |
| 2nd Pitch Pulse | X25 | 0 | 1 | 1 | 0 | 0 | 0 |
| 2nd Pitch Transpose Up | X26 | 0 | 1 | 1 | 0 | 0 | 1 |
| 2nd Pitch Transpose Down | X27 | 0 | 1 | 1 | 0 | 1 | 0 |
| LF Mod Mod 1 | X28 | 0 | 1 | 1 | 0 | 1 | 1 |
| LF Mod Mod 2 | X29 | 0 | 1 | 1 | 1 | 0 | 0 |
| LF Mod Saw | X30 | 0 | 1 | 1 | 1 | 0 | 1 |
| LF Mod Pulse | X31 | 0 | 1 | 1 | 1 | 1 | 0 |

With the capacitor and resistor connected in series as shown only a single pulse is coupled to the counter for each closing of the momentary switch. There is additional circuitry shown associated with counter 25B for resetting the counter so that it does not count through the full eight count. Both of the counters 25A and 25B may be of the conventional type made by Motorola and ifentified by number 4022.

The control panel 20, in addition to the indicator lights 116 and 118 include twenty other switches and corresponding indicators which are preferably light emitting diodes. There are thus a total of 30 light emitting diodes on the control panel and of the twenty switches ten are toggle switches and ten are momentary push-button switches. FIG. 1 shows the toggle switches and also the momentary switches.

The remotely controlled polyphonic synthesizer is equipped with six separate complete synthesizer subassemblies so that up to six notes may be usefully depressed simultaneously. This portion of the system is discussed in detail hereinafter with reference to FIG. 11. Each note is electronically assigned, within the synthesizer to a separate synthesizer voice. Each synthesizer voice incorporates two separate voltage controlled oscillators and these will be referred to as first pitches and second pitches. In this way six separate synthesizer voices may be played simultaneously, each voice controlled by a separate note and each voice incorporating a first and second pitch.

Figure 10:
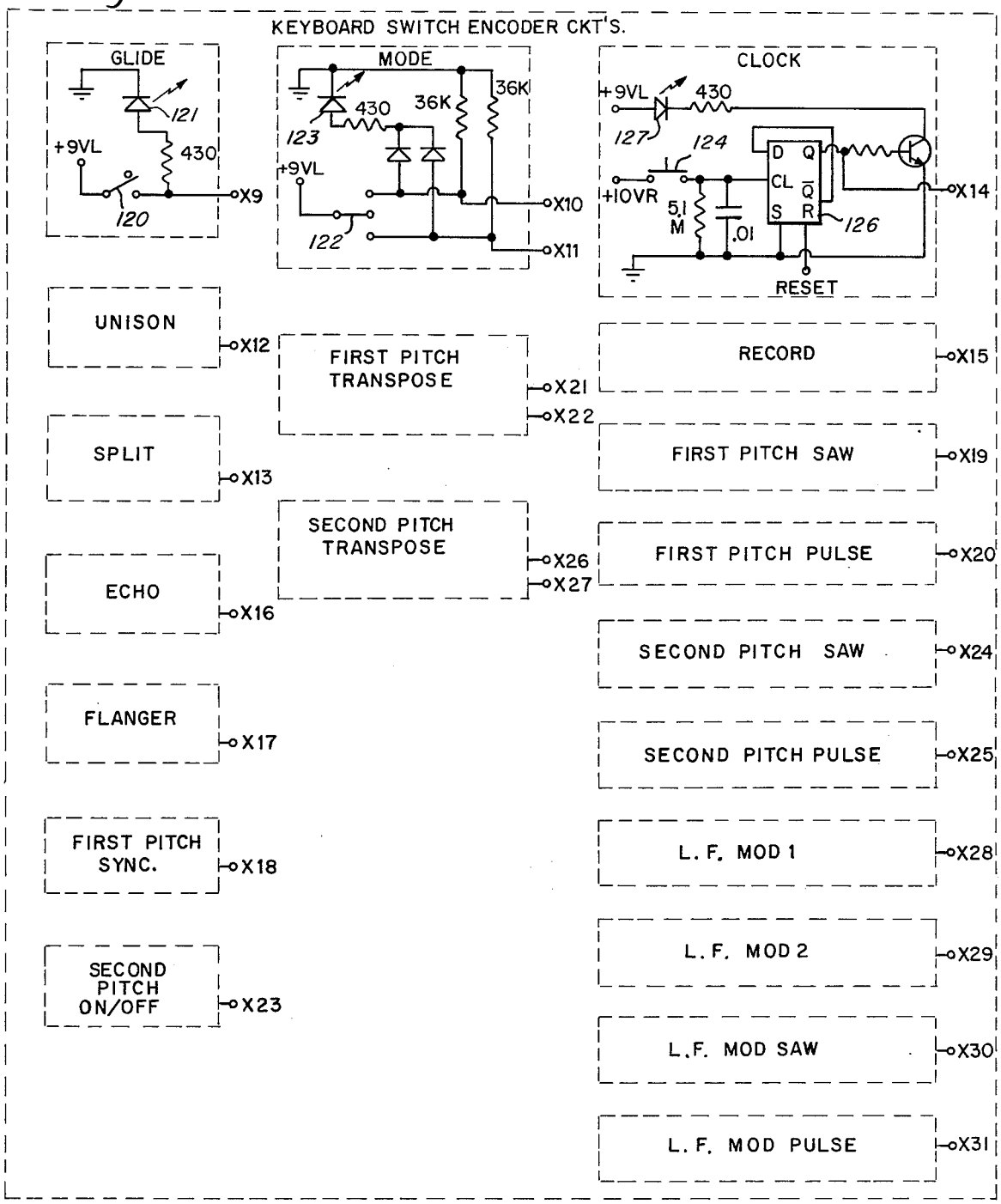
FIG. 10 is a diagram of the control switch circuits.

FIG. 10 shows the keyboard switch encoder circuit including three different types of circuits. Table I indicates the addresses corresponding to the switch outputs of FIG. 10. Seven of the switches such as the switch for controlling "glide" are simple on/off switches. Three of the switches are two-position toggle switches and the remaining ten switches are momentary push-button switches. FIG. 10 shows one of the on/off toggle switches 120 and associated indicator 121. When the switch 120 is closed the X9 signal is present and the corresponding indicator light 121 is illuminated. With regard to the "mode" switch, there is shown a two-position switch 122 which can generate either signals X10 or X11 depending upon the position of the switch. The switch has an indicator 123 associated therewith. The third type of switch circuit is shown as including a momentary push-button switch 124 having a flip-flop 126 associated therewith. When the switch 124 is even momentarily depressed the flip-flop 126 latches and the signal X14 is present at the same time lighting the indicator 127.

On the keyboard control panel adjacent to the indicators 116 and 118 there are four toggle switches, one of which is a two-position toggle switch. These switches provide remote control of the synthesizer keyboard electronics sub-assembly which assigns notes to voices and otherwise interfaces the keyboard to the six synthesizer voices. The first switch is used to select a "glide" (or portamento) mode. This is the slide trombone effect which is characterized by a slow transition between sequentially depressed notes. The transition is, in this embodiment, pre-set at the synthesizer. The second switch is a three-position selector switch (see switch 122, FIG. 10) which controls the assignment "mode". This is programming function in the synthesizer itself. The third toggle switch is used to select a "unison" mode such that all six synthesizer voices and assigned to one note at a time; whichever note is the first note depressed on the keyboard. The fourth toggle switch, labeled "split" is used to limit assignment of some voices to the lower half of the keyboard while the remainder are assigned to the other half of the keyboard.

The next two switches in sequence, as shown in FIG. 1 are momentary switches which are used to select an auxiliary sequencer which permits electronic recording of a note sequence while the "record" button is operative and replay of that sequence while the "clock" button is depressed.

In sequence the next two switches are simple toggle switches. The first of these switches is used to remotely select a remote "echo" device while another permits use of a "flanger" device. Both of these devices are used to process the output of the synthesizer. Both of these devices are also of conventional design and connection to the synthesizer is well known.

On the control panel there are next a group of four switches corresponding to the first pitch and thereafter another set of four switches corresponding to the second pitch. Both of these sets permit wave form selection such as a first or second pitch pulse or saw wave form. These switches are momentary switches shown at the center of each series as indicated in FIG. 1. A first pitch "sync" control is provided to permit phase locking of the first and second pitches. There is also provided a second pitch switch which permits selection of the second pitch or not. In each of these series there is also a transpose switch which is a multi-position switch shown in FIG. 10 as generating outputs X21 and X22 from the first pitch transpose and X26 and X27 from a second pitch transpose. These switches control the first and second pitch oscillators of the synthesizer.

Finally, there are four momentary push-buttons used for assignment and waveform selection of the low frequency vibrato oscillator. This outputs are identified in FIG. 10 as outputs X28, X29, X30, X31.

In FIG. 6 the serial pulse train is shown coupling on line 96 to the device 95A of the synthesizer. Device 95 is also shown in FIG. 11 as comprising a polyphonic voice assignment logic and control unit 95A having six pairs of output lines 95B coupling to six separate voice synthesizer units 95C. The synthesizer used with the device of this invention may be one sold by Oberheim Electronics Inc. of Santa Monica, California. The Units 95C shown in FIG. 11 are referred to as their expander modules.

The unit 95A as shown in FIG. 11 may be substantially of conventional design. This unit receives the serial input signal on line 96 and also receives the six bit address code. This unit includes gating for determining at any particular address whether the signal on line 96 is of a state to indicate that that particular key is depressed or not. The unit 95A also includes a memory register or the like which is periodically updated as each address code sequence is sent and contains at any one time an indication of which of the keys has been depressed. The unit 95A also includes preferably a priority circuit which selects one of the units 95C for each note played. Because this particular embodiment is limited to six synthesizer voices, only the first six notes played will be selected. One of the lines coupling to each unit 95C from unit 95A is a gate line permitting that particular unit to receive on its other input line a pitch control voltage corresponding to a first key played. Each of the other units 95C are in turn gated and supplied with a pitch control voltage corresponding to the subsequent keys played in the sequence.

As previously mentioned and with reference to FIG. 6, there is another signal coupled on line 98 which is a serial pulse train controlled from the address code on generator 92. This signal couples to the demultiplexers which may be a selectors similar to the selectors 88 and 89. The decoder 96A as shown in FIG. 6 may also be similar in construction to the decoder 87. Actually, the units 96A and 97 are connected very similarly to the units 87 and 89. The output of the unit 97 couples to a number of different devices which are well known circuits in the synthesizer which may be an Oberheim synthesizer which are to be remotely controlled by the serial pulse train on line 98. By way of example, if the "echo" switch has been activated, then in the particular time slot allocated to this pulse by the address code, there will be an enabling signal on line 98 which is conveyed by control of the address code to the output peak detector 99 associated with that particular function. The peak detector detects this signal and couples it by way of the Darlington switch 100 to a relay 102 which is operated to indicate that the "echo" circuit is to be in operation. All of the other switch positions are similarly assigned time slots for operation of other circuits from the output signals of the demultiplexer 97.

Figure 12:
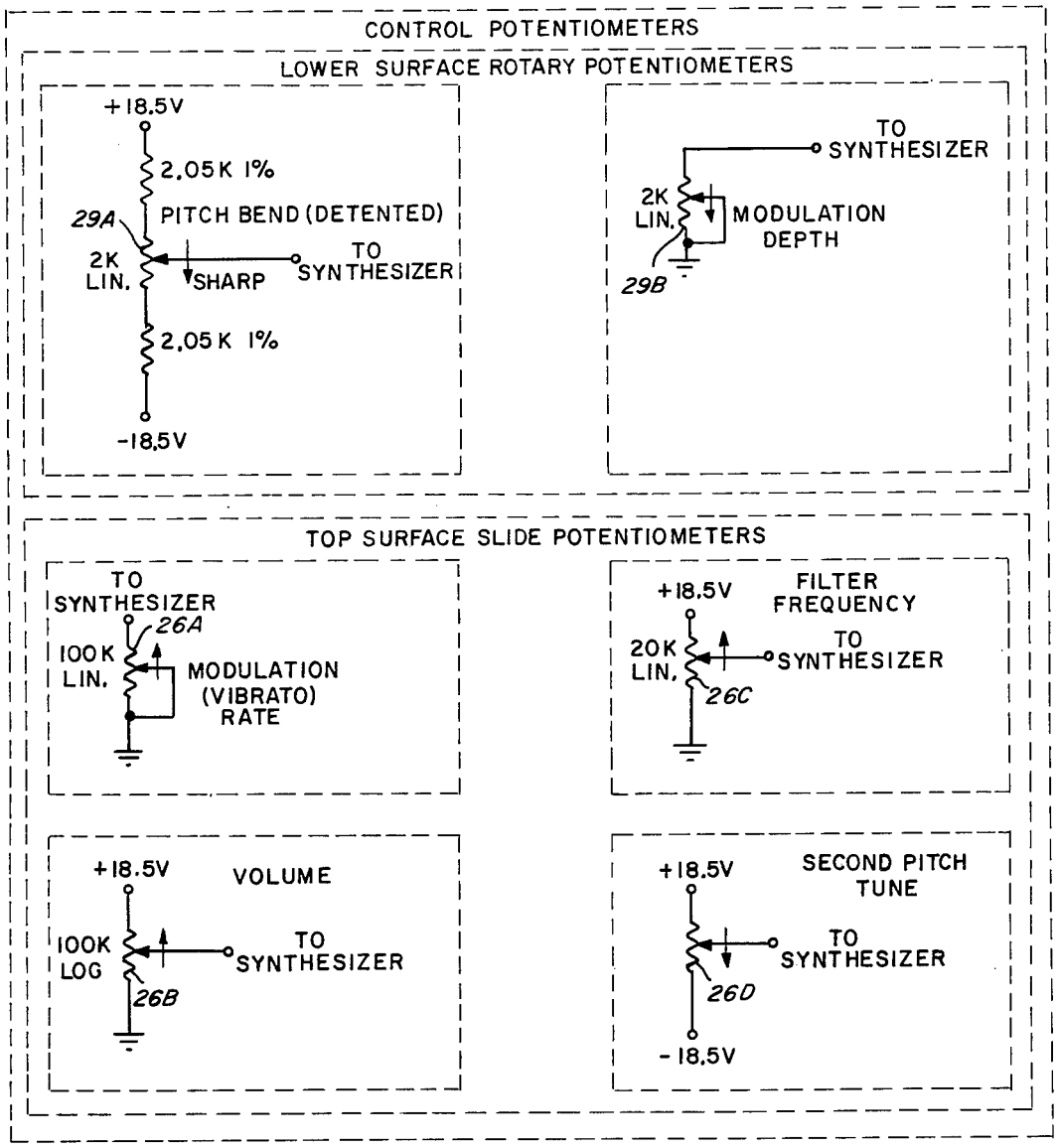
FIG. 12 is a circuit diagram showing the control potentiometers disposed adjacent the gripping passage in the housing.

In addition to the wiring shown in the umbilical cord 36 of FIG. 6 there are also some additional connections from the control knobs 26 and 29. FIG. 12 shows the four top surface slide potentiometers, 26A, 26B, 26C and 26D which provide control of the vibrato rate, volume, voltage controlled filter cut-off frequency, and relative running of a second set of keyboard controlled oscillators. Each of the potentiometers 26 may be a self-contained unit suitably supported as shown in FIG. 5 and each has one wire coupling by way of the umbilical cord to the synthesizer for control thereof.

FIG. 12 also shows the lower surface rotary potentiometers which are not shown in detail in FIGS. 1–5 but may be self-contained separately mounted potentiometers useable by the thumb of the player. These potentiometers are operable to control vibrato depth and pitch bend. The pitch bend control incorporates a center detent and allows for dynamic detuning both sharp and flat in response to thumb motion. FIG. 12 shows these as potentiometers 29A and 29B. Again, separate control wires will couple from each of these potentiometes via the umbilical cord to the synthesizer for control thereof.

Having described one version of the present invention it should now become apparent to those skilled in the art that numerous modifications can be made in the invention all of which are contemplated as falling within the scope of the invention. For example, in the preferred construction of the housing of the device, there has been shown a passageway in the form of a hole extending through the housing. In an alternate arrangement this passageway could be in the form of a slot preferably having potentiometer controls still on alternate surfaces adjacent to the slot. Although the number of wires communicating with the synthesizer has been reduced in accordance with the invention, it is contemplated that even further reduction in the number of wires in the cord 36 may be realized by incorporating, for example, a serial address code thereby requiring some memory storage in the device. In another arrangement the number of interconnections can be reduced by using a multiplexed line to carry both the keyboard and switch condition information in a single serial pulse train. In another embodiment a synchronization scheme can replace the address code wherein even only one sync pulse can be used for initiating key scanning as a means to establish a time reference.

What is claimed is:

1. A hand-held keyboard musical device comprising;
a keyboard assembly comprising a plurality of keys,
an elongated housing having top and bottom wall surfaces, a hand-support section and a keyboard section longitudinally disposed of the support section and having an opening for accommodating the keyboard assembly,
said housing having means defining a passage therethrough in the hand-support section of the housing adjacent to the keyboard assembly and extending between top and bottom wall surfaces,
said passage for receiving the player's hand for enabling hand support of the device,
and means for supporting the housing from the player's body.

2. A musical device as set forth in claim 1 wherein said keyboard assembly comprises support means for the keys of the keyboard assembly, biasing means for urging the keys to a nondepressed position, and means for adjusting the horizontal position of the keys on an individual key basis.

3. A musical device as set forth in claim 1 wherein said keyboard assembly includes chassis support means for the keys and individual optical interruptor means associated with each key for sensing key depression.

4. A musical device as set forth in claim 3 wherein each optical interruptor means includes a light source, a light baffle secured to the key and a photo sensor.

5. A musical device as set forth in claim 1 wherein said key support means comprises a common support shaft and support bracket having access means to said means for adjusting, said biasing means including a spring having one end engaging a stop covering said access means.

6. A musical device as set forth in claim 1 wherein said housing has means defining a control panel and a plurality of switches mounted on said control panel.

7. A musical device as set forth in claim 6 wherein said control panel is mounted above said keys viewed from the player's position, the plane of said control panel being tilted relative to the plane of the keys for easy viewing by the player.

8. A musical device as set forth in claim 1 wherein said passage extends in the direction of key depression.

9. A musical device as set forth in claim 1 including control knob means arranged adjacent the passage on the top surface of the housing for manipulation by the player's finger.

10. A musical device as set forth in claim 9 including second control knob means arranged adjacent the passage on the bottom surface of the housing.

11. A musical device as set forth in claim 9 including switch means disposed adjacent the control knob means and arranged for finger contact by the same fingers controlling the control knob means.

12. A musical device as set forth in claim 1 wherein said means for supporting includes a strap and means affixing the strap to the housing at two points of connection.

13. A musical device as set forth in claim 12 wherein the space between the points of connection is less than the length of the keyboard.

14. A musical device as set forth in claim 1 for controlling a remote voice-generating apparatus and comprising conductor means for sending a serial pulse train from the device indicative of depressed keys.

15. A musical device as set forth in claim 6 for controlling a remote voice-generating apparatus and comprising conductor means for sending a serial pulse train from the device indicative of switch position.

16. A musical device as set forth in claim 1 wherein said bottom wall surface is substantially flat forming a resting surface for the device when used in a flat stationary position.

17. A muscial device as set forth in claim 1 wherein said passage is elongated and extends longitudinally of the housing.

18. A musical device as set forth in claim 17 wherein the length of thepassage is at least on the order of the width of the player's fist.

19. A musical device as set forth in claim 9 wherein the control knob means include a plurality of adjustable knobs extending longitudinally of the passage and housing.

20. A musical device as set forth in claim 1 including control means manually operable by the player and disposed adjacent said passage for easy access by the player's fingers.

21. A musical device as set forth in claim 20 wherein said passage has means defining a gripping surface for hand supporting the device and also enabling operation of said control means.

22. A hand-held keyboard musical device for controlling a remote synthesizer apparatus, comprising;

a keyboard assembly, an elongated housing having top and bottom wall surfaces, a hand-support section and a keyboard section longitudinally disposed of the support section and having an opening for accommodating the keyboard assembly and means for supporting the housing from the player, means responsive to key actuation for registering an individual indication representative of each key actuated, umbilical cord means interconnecting the synthesizer apparatus and the device and including a number of signal wires, synchronization means coupled via the umbical cord means to the device, selector means responsive to said means for registering and said synchronization means for providing a serial pulse train on at least one of said signal wires having time slots indicative respectively or each key and the state thereof, said housing having means defining a passage therethrough in the hand-support section of the housing adjacent the keyboard assembly and extending between opposite top and bottom wall surfaces, said passage for receiving the player's hand for enabling hand support of the device, and means for supporting the housing from the player's body.

23. A musical device as set forth in claim 22 including control panel means having a plurality of control switches, and second selector means responsive to the positions of said control switches and said synchronization means for providing a serial pulse train on at least one of said signal wires having time slots indicative respectively of each control switch and the state thereof.

24. A musical device as set forth in claim 23 wherein said control switches comprise momentary swtiches and toggle switches.

25. A musical device as set forth in claim 22 including hand adjustable potentiometer means mounted from the housing and having control to the synthesizer apparatus via signal wires connecting from each potentiometer.

26. A musical device as set forth in claim 22 including pulse switch means and associated counter means disposed within the housing, said pulse switch means controlling the state of said counter means to provide signals on said signal wires.

27. A hand-held keyboard musical device for controlling a remote synthesizer apparatus, comprising;

a keyboard assembly an elongated housing having top and bottom wall surfaces, a hand-support section and a keyboard section longitudinally disposed of the support section and having an opening for accommodating the keyboard assembly, means responsive to key actuation for registering an individual indication representative of each key actuated, umbilical cord means interconnecting the synthesizer apparatus and the device and including a number of signal wires, synchronization means coupled via the umbilical cord means to the device, control panel means having a plurality of control switches, selector means responsive to the positions of said control switches and said synchronization means for providing a serial pulse train on at least one of said signal wires having time slots indicative respectively of each control switch and the state thereof, said housing having means defining a passage therethrough in the hand-support section of the housing adjacent the keyboard assembly and extending between opposite top and bottom wall surfaces, said passage for receiving the player's hand for enabling hand support of the device, and means for supporting the housing from the player's body.

* * * * *